United States Patent [19]

Gustin et al.

[11] Patent Number: 5,054,108

[45] Date of Patent: Oct. 1, 1991

[54] HEATER AND METHOD FOR DEIONIZED WATER AND OTHER LIQUIDS

[76] Inventors: Arnold Gustin; Kevin McGillivray, both of 28210 Crocker Ave., Suite 301, Valencia, Calif. 91355

[21] Appl. No.: 31,988

[22] Filed: Mar. 30, 1987

[51] Int. Cl.[5] ..... F24H 1/10; H05B 3/00

[52] U.S. Cl. ..... 392/492; 392/422; 392/489; 392/503

[58] Field of Search ..... 219/294–309, 219/338, 523; 392/422, 489, 503; 492, 491

[56] References Cited

U.S. PATENT DOCUMENTS

| | | | |
|---|---|---|---|
| 1,873,820 | 8/1932 | Carpenter | 219/306 |
| 2,033,443 | 3/1936 | Moses | 219/318 X |
| 3,546,431 | 4/1969 | Gibbs | 219/335 |
| 4,059,520 | 11/1977 | Roller | 219/306 X |
| 4,145,601 | 3/1979 | Lavrentiev et al. | 219/338 X |
| 4,461,347 | 7/1984 | Layton et al. | 219/523 X |
| 4,534,282 | 8/1985 | Marinoza | 219/338 UX |

FOREIGN PATENT DOCUMENTS

| | | | |
|---|---|---|---|
| 194975 | 9/1986 | European Pat. Off. | 219/306 |
| 681766 | 9/1939 | Fed. Rep. of Germany | 219/338 |
| 563945 | 9/1944 | United Kingdom | 219/301 |

*Primary Examiner*—Anthony Bartis

[57] ABSTRACT

A heater for heating dionized water and other liquids which may be very aggressive solvents, the heater constituting one or more heating units having an external cylindrical housing of PTF Teflon or similar material and closed at each end with headers of similar material which contain ports for ingress and egress of the fluid. A concentric inner tubular member of polysilicon surrounds one or more infra red heating elements which, when energized, radiate intense heat into the chamber within the inner tube. This tube acts to confine and reflect the heat back into the chamber thereby heating the liquid to a high temperature very quickly. Relatively little heat passes through the wall of the inner tube to the surrounding chamber. Liquid is directed into the outer chamber, across the length of the inner tube, through a passage at the opposite end and into the inside chamber. The flow across the other surface of the inner tube is warmed somewhat but insufficiently to damage the outer tube. A purge circuit is included to remove all air bubbles, etc., and a pressure switch responds responds to over and under pressures to deenergize the heaters to protect the system.

7 Claims, 2 Drawing Sheets

10
12
12a
12b
12c
14
14a
14b
14c
16
18
20
22
24
25
26
28
30
32
33
34
36
38
40
42
45
70
2
PURITY CELL
DRAIN
DRAIN
PRESSURE RELIEF VALVE
TEMPERATURE DETECTOR
PRESSURE SENSOR
HEATED FLUID OUTLET
AMBIENT FLUID INLET

FIG. 4
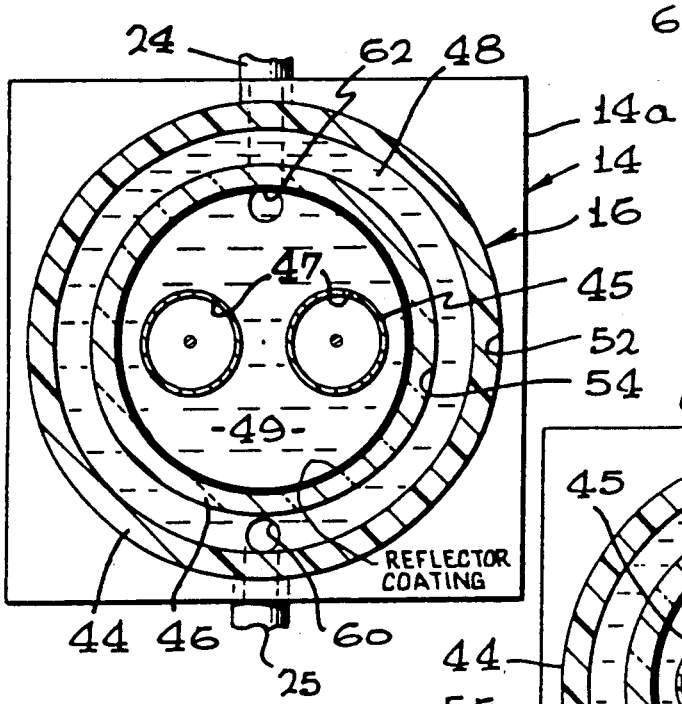
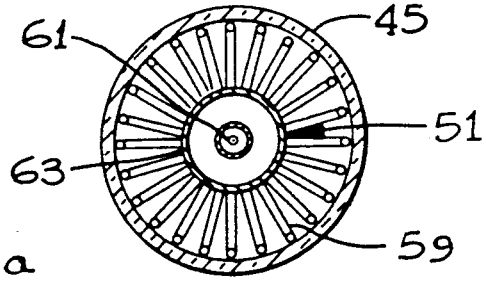
FIG. 5
FIG. 3
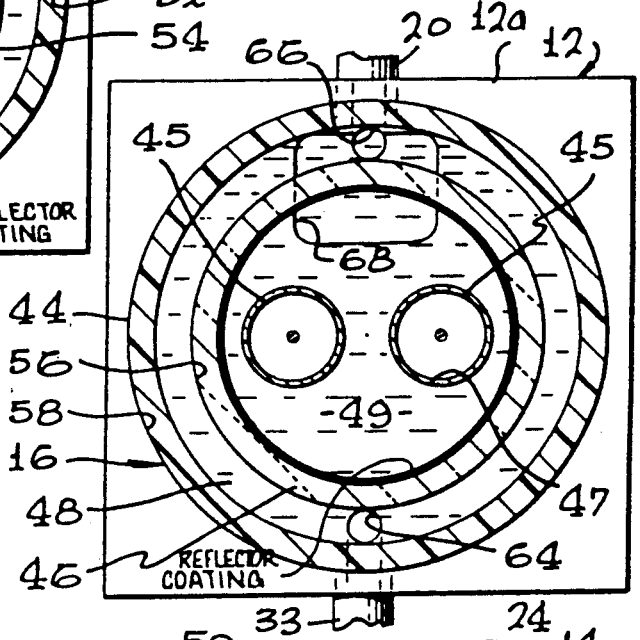
FIG. 2
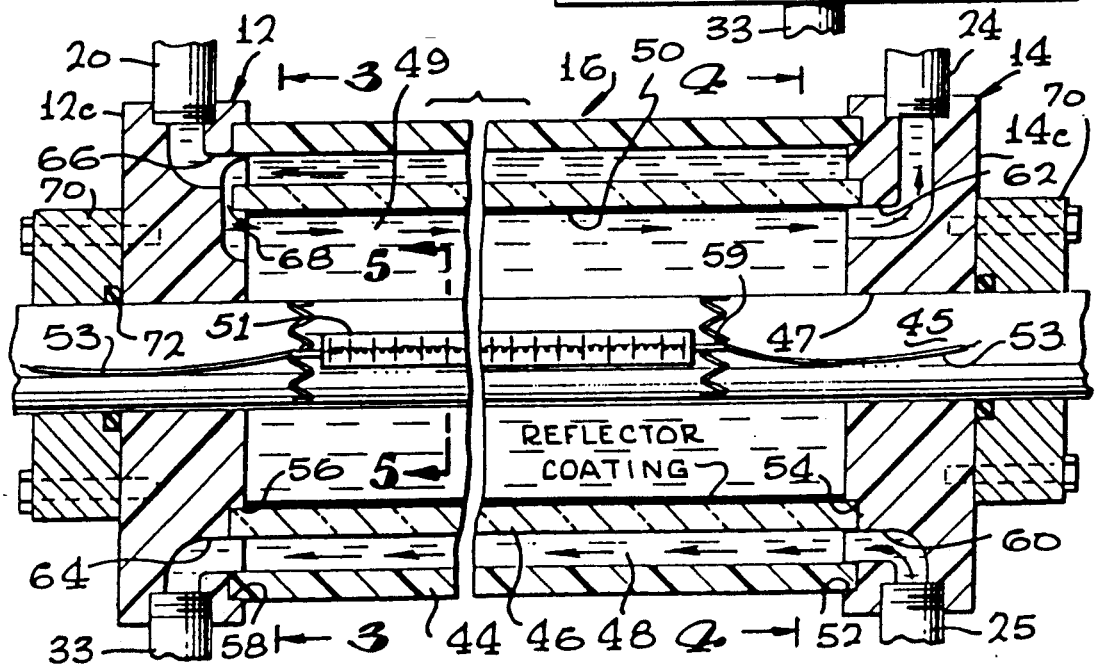

HEATER AND METHOD FOR DEIONIZED WATER AND OTHER LIQUIDS

BACKGROUND OF THE INVENTION

This invention relates to a method and apparatus for heating deionized water or other processing liquids to a desired high temperature and for maintaining a flow of such heated liquid at desired commercial rates. There has long been a need for a reliable heater for heating deionzed water and other processing liquids to fairly high temperatures such as 90 degrees Celsius and for providing a reliable constant flow of such water or liquid particularly for use in semi-conductor manufacturing and also for certain other bio-medical processes and cleaning applications. There are and have been a number of heating devices for deionized water, but those presently available have shortcomings or limitations of one kind of another. Because deionized water is such an effective solvent, it wants to dissolve or liberate ions from almost any metallic object that it comes in contact with. Consequently, there are only a limited number of materials commonly in use for containing and/or transporting deionized water, particularly, hot deionized water. Such hot deionized water is used in semi-conductor manufacturing in cleaning the usual semi-conductor substrate material, such as silicon and removing undesired particles therefrom. In order to contain hot deionized water, it is necessary to use very inactive materials such as polytetrafluoroethylene (PTFE Teflon) or, PFA Teflon (Perfluoroalkoxy) Teflon or PVDF (polyvinylidene fluoride) all of which materials are useful up to temperatures somewhat below their melting points. For substantially higher temperature applications, such materials as titanium or gold plated 214 quartz or gold plated polysulfone, PTFE, synthetic sapphire, or polysilicon may be used. The particular choice of materials, as will be appreciated by those skilled in the art, depends upon the temperatures generated in a particular heated design and also as to the particular processing liquid which is being heated. While it is common to use Teflon to contain deionized water it has limited ability to withstand heat. It has been a practice to heat deionized water by means of Teflon coated heater wires. These are susceptable to burning out because of overheating the Teflon, thus exposing the heating wires which contaminates the water. Another system which has been used involves the use of an immersion heater in a tank, heating water through which run a number of Teflon tubes carrying the deionized water, thus the heat from the tank passes through the walls of the Teflon tubes the arrangement operating like a heat exchanger. But this last system is limited in the temperature it will accommodate because of the Teflon, which, of course, limits the rate of heat transfer to the deionized water.

Water, particularly warm water, is a favorable growth medium for many kinds of organisms such as bacteria and fungi. A heater involving a reservoir of any substantial size wherein the heated deionized water is caused or permitted to stand for any significant time is highly susceptible to the undesirable generation of such organisms.

From the foregoing it will be appreciated that there is a need for a heater for deionized water and other processing liquids which will heat the water quickly to a temperature such as 90 degrees Celsius which can continue to supply deionized water at such temperature in commercial quanitites without significant degradation over a substantial range of flows.

SUMMARY OF THE INVENTION

It is an object of the present invention to provide a heater which meets the above flow and temperature requirements and which requires storage of minimum volumes of heated deionized water to avoid the growth of bacteria and fungi.

It is another object of the present invention to supply such a heater which is highly reliable and capable of continuous service without frequent breakdown.

It is a further object of the present invention to provide a method of heating deionized water which is much faster than possible by systems presently in use.

The present invention accomplishes the above objects by providing a method and apparatus in which an infra red heater produces temperatures significantly above the desired temperature of the water to be delivered which heater is contained within a reflecting tube which concentrates the heat from the heater so that water passing between the heater and the reflecting tube is quickly raised to the desired temperature as it flows through the reflecting tube. The tube and heater are contained within a chamber which is preferably cylindrical and coaxial with the tube. The deionized water entering this chamber flows along the outside of the reflecting tube, is then redirected through the reflecting tube and out of the heater to be used for its intended purpose. Because of this arrangement there is direct heating of the water within the reflecting tube by infra red radiation in only such quantities as are immediately needed, thus avoiding heating the deionized water in a reservoir of substantial size. The water flows through only once and by flowing first on the outside of the reflecting tube and then through the reflecting tube a substantially constant fluid pressure is maintained on both sides of the reflector tube which avoids subjecting it to physical stress. Such heat as passes through the reflecting tube preheats the water and prevents overheating of the material of the chamber. The preferred type of heater is a commercially available electrically heated elongated quartz heating tube and for deionized water the preferred reflecting tube is of polysilicon. It will be appreciated that this material is essentially the same or very similar to the silicon semi-conductor material which it is desired to clean which offers an advantage. Recognizing that even the best deionized water frequently contains some sodium ions which it is desired to avoid depositing on the semi-conductor wafers to be cleaned, by passing the heated water through the polysilicon reflecting tube which is of material similar to to that being cleaned, such sodium ions tend to become captured in the reflecting tube, rather than being allowed to pass on to the silicon or other semi-conductor materials which is desired to clean.

The external housing is preferably of PVDF material and the associated pipes and conduits are preferably of Teflon which will withstand temperatures in the range of 120 degrees Celsius. If higher temperatures are required, PFA Teflon will withstand temperatures of 145 degrees C.

DESCRIPTION OF THE DRAWINGS

FIG. 2 is a cross sectional view of a single heater element incorporating our invention;

FIG. 3 is a cross sectional view taken along line 3—3 of FIG. 2; and

FIG. 4 is a cross sectional view taken along line 4—4 of FIG. 2.

FIG. 5 is a cross-sectional view taken along line 5—5 of FIG. 2.

DESCRIPTION OF THE PREFERRED EMBODIMENT

Figure 1:
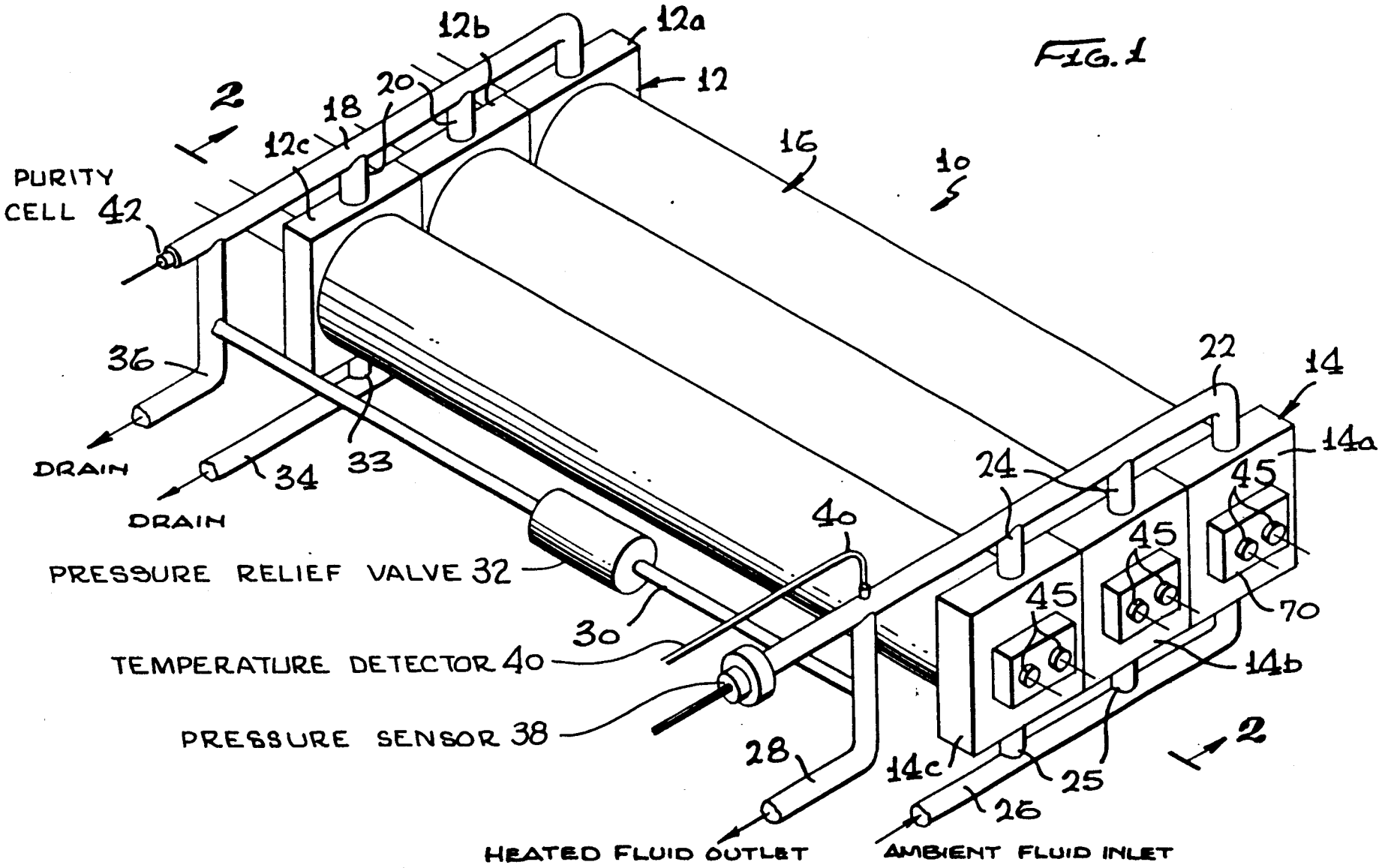
FIG. 1 is a perspective view of a group of heating units incorporating our invention connected together in parallel.

FIG. 1 is a perspective drawing of a fluid heater 10 according to our invention in which three separate heat exchange units 16 are coupled together to provide a larger volume of heated fluid than would be obtainable from a single such unit. The units 16 are connected to a first header array or manifold 12 at one end and a second header array or manifold 14 at the opposite end. Each section of the header array bears a subscript, e.g., header sections 12*a* and 14*a* are applied to the heat exchange unit 16 located toward the right. Header units 12*a*, 12*b* and 12*c* are connected at the top through short pipe sections 20 to a transverse pipe 18 connected to a drain line 36. At the end of pipe 18 is a purity cell 42 which is connected to a monitor. At the lower edges of header units 12*a*, 12*b* and 12*c* are downwardly directed short pipes 33 which connect with a drain line 34. Header units 14*a*, 14*b*, and 14*c* are connected at the top through short pipe sections 24 to a horizontal pipe 22 which connects to an outlet pipe 28 which delivers heated fluid. At the lower edges of units 14*a*, 14*b* and 14*c* are short downwardly directed pipes 25 which connect to a pipe 26 which supplies the fluid at ambient temperature to the heater 10. Seal support blocks are shown at numeral 70 for supporting a plurality of quartz tubes 45 carrying connecting electrical power to infrared heating elements inside of heat exchange units 16. Lines 28 and 36 are connected by a small diameter conduit 30 leading to a pressure relief valve 32 which relieves excessive pressures in the heater 10. A remote pressure switch (not shown) operates in conjunction with a gauge guard 38 which includes a Teflon diaphragm that isolates the process water from the pressure sensor. Pressures sensed inside the heater create the same pressure on the other side of the diaphragm sensed by the pressure sensor switch 38. If the switch 38 senses pressure below a given threshold such as 10 psi, or above a substantially higher level such as 70 psi., it operates to disconnect the heating elements to protect the system. A resistance temperature detector 40 connected to line 22 operates to monitor the fluid outlet temperature.

FIG. 2 is a cross sectional view taken along line 2—2 of FIG. 1. In this view the heat exchange unit 16 is shown with header members 12 and 14 attached at each end of an external tube 44. All are formed, preferably, of PVDF material. Concentrically positioned within tube 44 is an internal tube 46 which, preferably, is of polysilicon. It could be of other materials such as quartz with an inner reflecting coating 50 of gold, or quartz with an inner reflecting coating of polysilicon. Header 14 receives the deionized water or other fluid through pipe 25 which intersects curved passageway 60 and flows into a chamber 48 between tubes 44 and 46. It then flows across an opening 68 in header member 12 and into chamber 49 in the interior of tube 46 where it is exposed to the energy radiating through the quartz tubes 45 containing lamps 51 having electrical resistance heater elements connected to a source of electrical power through wires 53. This heat also reflects from the surface 50 back into chamber 49. While the number of heater units may vary to suit requirements, it has been found that two quartz tubes 45 each containing a heating lamp 51 of a type commercially available are satisfactory where the internal diameter of tube 46 is approximately 2.65 inches. Heated water flows from the opposite end (header 14) into a curved passage 62 and to pipes 24 and 22 to the outlet pipe 28.

FIG. 3 is a cross sectional view taken along line 3—3 of FIG. 2. In this view are shown ports constituting the ends of passages 64 and 66. Passage 66 is connected to pipes 20 and 18 which connect to drain pipe 36. It has been found undesirable to permit air in the heater and any such air will tend to locate at pipe 18 which is the highest point in the system. A valve (not shown) in pipe 36 permits a limited flow through pipe 36 to permit all air to be purged from the heater and all pipes and passages. A very limited continuous flow of about 0.25 gallons per minute is permitted through pipe 36 to assure constant purging. Passage 64 and pipe 33 lead to drain line 34 which are used to drain the heater. Visible in this view are ports 47 which receive the heater tubes 45. Tubes 45 are carried in heater members 12 and 14 and leakage along the surface of tubes 45 is blocked by means of conventional O-rings 72 (FIG. 2).

FIG. 4 is a cross sectional view along line 4—4 of FIG. 2. Passage 62 is shown which communicates with pipe 24 leading to the outlet pipe 28 for heated fluid. Passage 60 is shown in communication with pipe 25 which supplies the deionized water or other fluid to be heated.

FIG. 5 is a partial cross-sectional view taken along line 5—5 of FIG. 2 which shows the quartz tube 45 in cross-section with the lamp 51 also in cross section therein. Support springs 59 are also shown in this view as are filmanet 61 and the tubular envelope 63 of lamp 51.

When it is desired to operate the heater, line 26 is connected to a source of fluid to be heated and the drain pipe 36 purging the system of air bubbles or pockets. The lamps 51 are then energized and fluid in chamber 49 is heated. The heat radiating from each lamp 51 passing through its respective quartz tube 45 impinges on surface 50 and is reflected back into the fluid to be heated causing a very concentrated heating effect on the fluid in chamber 49. Whether tube 46 is of quartz with a reflecting layer 50 of gold or of polysilicon as described, a relatively small amount of heat passes through the wall of tube 46 into the fluid in chamber 48, consequently, the fluid in chamber 48 is heated to only a limited amount and the external tube 44 is heated to only a limited degree as fluid flows along the surfaces of tubes 44 and 46 toward opening 68. Once fluid moves into chamber 49, it is exposed to a very intense heating effect, as described above, and is heated to the desired temperature before entering the outlet passage 62. The temperature of the heated fluid is sensed by the resistance temperature detector 40 and is supplied to an external control circuit, not a part of the present invention. Should overpressure develop in the heater, this is sensed by valve 32 which will open to permit heated fluid to be discharged into drain line 36. Should the fluid pressure in the pipe 22 drop below a specified value, it is sensed by the pressure switch, not shown, connected to a gauge guard 38 which will operate through an external control circuit to deenergize the heater 45.

Such low pressures indicate low fluid flows and that the supply of fluid has been interrupted in some manner. An excessively high pressure would indicate that the discharge line is no longer open or is restricted. In either event, if the heater elements continued to heat, would tend to produce over temperature and excessive internal pressures.

The fluid heater described overcomes a number of the disadvantages of similar heaters discussed above. It produces deionized water at high temperatures such as 90 degrees Celsius in commercially useful quantities such as two gallons per minute or more without requiring that any substantial quantity of heated water be stored, with the attendant danger of developing microorganisms in the supply. All the pipes and passages are of Teflon or similar material which can safely handle deionized water or many other fluids. The polysilicon tube is capable of withstanding all the heat generated by the heaters and of reflecting heat back into the fluid to heat the fluid rapidly and the concentric tube arrangement provides assurance that the outer tube is not heated excessively, thus permitting the use of PVDF material or PTF Teflon for this tube as well as for the headers. The quartz heating lamps are commercially available and not subject to overheating nor will they contaminate the heated fluid, as in the case of Teflon coated heating wires which can burn off the Teflon leaving the unprotected wires subject to attack by the heated fluid. The heater described although particularly useful for heating deionized water, is useful for heating many fluids (other than hydrofluoric acid) since the materials used will even withstand sulfuric acid. It is not designed to heat hydrofluoric acid, which will attack the polysilicon as well as the quartz. It is recognized that those skilled in the art will be aware of modifications which may be made to the embodiment described above and we do not wish to be limited other than by the appended claims.

We claim:

1. A heater for heating a process liquid, such as deionized water, to a desired high temperature and for maintaining a flow of such heated process liquid at a desired rate comprising:

at least one heat exchange unit, each heat exchange unit comprising an elongated radiant heating element encased in a quartz tube;

an elongated heat reflecting tube of quartz with an inner reflecting layer of polysilicon, said reflecting tube enclosing said heat element and having an internal diameter substantially greater than required to enclose said quartz tube encasing said heating element to form a first flow passage therebetween;

means defining a chamber enclosing said heat reflecting tube and made of a high temperature thermoplastic material which is weldable and non-reactive with the process liquid defining a second flow passage surrounding said reflecting tube, emans closing the ends of said flow passages, said chamber including an inlet port at one end thereof connected to a source of a processing liquid, a port at the end remote from said one end of said chamber communicating said second flow passage with said first flor passage, and an outlet extending from the said first flow passage at said first end of said chamber for supplying sid liquid at said desired temperature.

2. A hetaer for heating a process liquid, such as deionized water, to a desired high temperature and for maintaining a flow of such heated process liquid at a desired rate comprising:

at least one heat exchange unit, each heat exchange unit comprising an elongated radiant heating element encased in a quartz tube;

an elongated heat reflecting tube of quartz with an inner layer of gold, said tube enclosing said heating element and having an internal diameter substantially greater than required to enclose said quartz tube encasing said heating element to form a first flow passage therebetween;

means defining a chamber enclosing said heat reflecting tube and made of a material substantially unaffected by and non-reactive with said liquid at said desired temperature defining a second flow passage surrounding said reflecting tube, means closing the ends of said flow passages, said chamber including an inlet port at one end thereof connected to a source of a processing liquid, a port at the end remote from said one end of said chamber communicating said second flow passage with said first flow passage, and an outlet port extending from the said first flow passage at said first end of said chamber for supplying said liquid at said desired temperature.

3. A heater for heating a process liquid, such as deionized water, to a desired high temperature and for maintaining a flow of such heated process liquid at a desired rate comprising:

at least one heat exchange unit, each heat exchange unit comprising an elongated radiant heating element encased in a quartz tube;

an elongated heat reflecting tube of a polycrystalline silica material, said reflecting tube enclosing said heating element and having an internal diameter substantially greater than required encasing said heating element to enclose said quartz tube to form a first flow passage therebetween;

means defining a chamber enclosing said heat reflecting tube and made of a material substantially unaffected by and non-reactive with said liquid at said desired temperature defining a second flow passage surrounding said reflecting tube, means closing the ends of said flow passages, said chamber including an inlet port at one end thereof connected to a source of a processing liquid, a port at the end remote from said one end of said chamber communicating said second flow passage with said first flow passage, and an outlet port extending from the said first flow passage at said first end of said chamber for supplying said liquid at said desired temperature.

4. A heater as claimed in claim 3 wherein said heating element comprises an infra red lamp and includes an elongated electrical heating element sealed within a quartz tube.

5. A heater as claimed in claim 3 wherein a plurality of said heat exchange units are provided, said heat exchange units having their inlet ports connected by a manifold to a source of liquid and the outlet ports from each of said heat exchange units are also connected to a common heated liquid supply line.

6. A method of heating deionized water to a temperature of approximately ninety degrees Celsius and for maintaining a flow of said deionized water at a desired rate at said temperature comprising:

(1) providing a heat exchange unit by providing a plurality of infra red heating elements encased in quartz tubes, forming a heat reflecting tube of polycrystalline silica material of diameter substantially larger than required to enclose said quartz tubes and installing said quartz tubes in said heat reflecting tube in spaced relation thereto, forming a generally cylindrical chamber enclosing said heat reflecting tube of plastic material which is substantially unaffected by deionized water at approximately ninety degrees Celsius, and of diameter significantly larger than that of said heat reflecting tube, providing one end of said chamber with an inlet port connected to a source of deionized water, providing a port on said tube at a location remote from said port for communicating said chamber with the interior of said tube and providing an outlet port remote from said communicating port and extending from the interior of said heat reflecting tube to the exterior of said chamber to supply said chamber hot deionized water, (2) causing deionized water to flow into said inlet port, and (3) energizing said heating elements.

7. A method of heating deionized water as claimed in claim 6 including providing a plurality of such heat exchange units and connecting them in parallel between a source of said deionized water and a supply line.

* * * * *